United States Patent [19]

Glick

[11] 3,973,687

[45] Aug. 10, 1976

[54] SAFETY CAP FOR CONTAINER

[75] Inventor: Allan Glick, Douglaston, N.Y.

[73] Assignee: Lawrence Peska Associates, Inc., New York, N.Y. ; a part interest

[22] Filed: Apr. 24, 1974

[21] Appl. No.: 463,726

[52] U.S. Cl. ..... 215/207; 215/215; 70/169; 220/210

[51] Int. Cl.[2] ..... B65D 55/14

[58] Field of Search ..... 215/207, 215, 9, 302; 220/55 K, 210; 70/168, 169

[56] References Cited

UNITED STATES PATENTS

| | | | |
|---|---|---|---|
| 3,136,148 | 6/1964 | Nehls | 70/169 |
| 3,151,756 | 10/1964 | Gruen | 215/207 |

FOREIGN PATENTS OR APPLICATIONS

| | | | |
|---|---|---|---|
| 797,221 | 6/1958 | United Kingdom | 220/210 |

*Primary Examiner*—George T. Hall

[57] ABSTRACT

A safety cap for bottles, jars, and containers which contain pills, medicines, or dangerous substances, the cap being lockable onto the container and cannot be unlocked or opened with the insertion of anything but a suitable key through the cap. Where the bottle or jar has an inner abutment or rib, the safety cap has radially extensible locking rods in bores in the cap body, and resiliently biased to protrude into an annular interspace between the outer and inner walls of the cap, into which the neck of the bottle is received. The rods snap into latched position under the abutment, and are retracted by only insertion and rotation of the key.

4 Claims, 5 Drawing Figures

SAFETY CAP FOR CONTAINER

This invention relates to improvements in safety caps for containers such as pill and medicine bottles or jars, and also bottles or cans which contain poisonous or dangerous household cleaners.

An object of the invention is to provide a novel and improved safety cap for containers, bottles and cans in which the cap is locked in closed position to safeguard against removal of pills, medicines, drugs or other dangerous contents, by children and other persons for their own safety.

Another object of the invention is to provide a novel and improved safety cap for bottles, containers and the like, in which the cap body fits over the mouth of the container, and includes locking means which can only be opened by a key, the locking means including lock portions which engage with the container so that the contents cannot be discharged or reached by children, or other persons who might take an overdose and thus suffer injury.

A further object of the invention is to provide a novel and improved safety cap and locking device construction for bottles, containers and the like, in which the neck of the bottle has an inner annular lip or rib, and the safety cap has a number of radially extensible latch members which are normally spring biased to locking positions under the annular rib to block removal of the cap, and in which rack and pinion means are employed to retract the latch members by means of a key to open the container.

Still another object of the invention is to provide a novel and improved safety cap and locking device construction, which is simple in design, is made of only a very few parts, and is adaptable to the usual types of pill and medicine bottles, and other containers, so that its external appearance is much similar to conventional caps, and which can be made at low cost by mass production methods.

The above and other objects and advantages of the invention will become apparent from the following description of a preferred embodiment thereof, as illustrated in the accompanying drawings, forming a part hereof.

Figure 1:
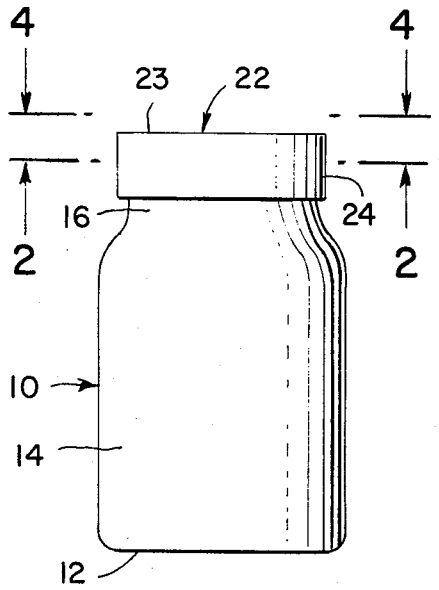
FIG. 1 is a side elevational view of a container according to the invention, the safety cap being in closed position thereon.

In connection with the use of medicines, pills, drugs and other preparations, it has been found that many cases occur of accidental injury or even death from taking an overdose of the pills or other medications. Even such commonly used drugs as aspirin pills are believed to be a major cause of accidental illness and death, especially when taken by small children who might actually take the entire contents without knowing the danger.

Similar hazards exist when the bottle or container has noxious bleaches, cleaning fluids, or corrosive substances, and germicidal preparations, and it has been found that small children, disregarding the bad taste of such preparations, will drink them anyway. The present invention avoids much of this danger by making use of a locking cap and bottle construction, so that the cap cannot be removed without using a simple key, or a more complicated key.

In order to understand clearly the nature of the invention, and the best means for carrying it out, reference may be had to the drawings, in which like numerals denote similar parts throughout the several views.

As shown, there is a bottle, jar or other container 10, with bottom 12 and side walls 14, the upper end or neck portion 16 being slightly reduced in diameter to form the bottle mouth or discharge opening 18. An annular lip or rib 20 is moulded on the inside of the bottle neck for engagement with the bottle cap 22. The bottle cap 22 has its top wall 23 formed with an annular depending outer skirt wall 24 and an inner hub wall 25 spaced from the outer wall by the annular interspace recess 26.

Figure 2:
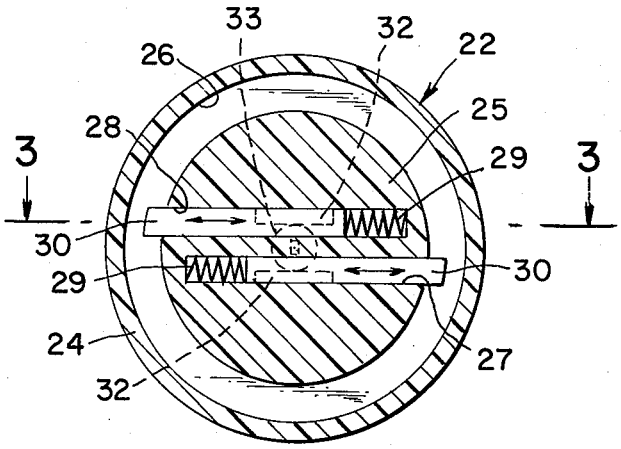
FIG. 2 is a sectional plan view taken substantially on plane 2—2 of FIG. 1.
Figure 3:
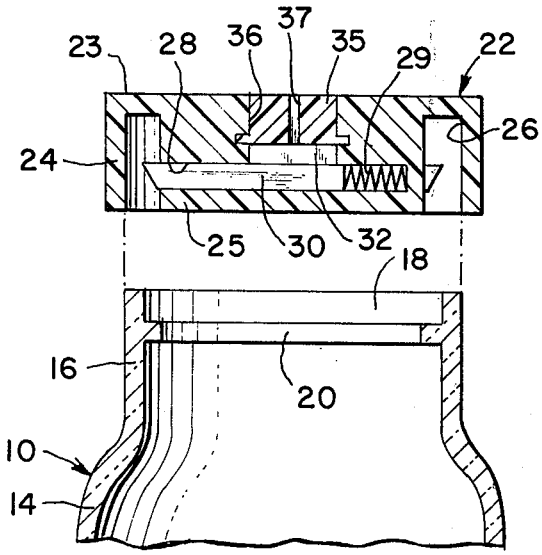
FIG. 3 is a sectional elevational view taken substantially on plane 3—3 of FIG. 2, the cap being shown separated from the bottle.
Figure 4:
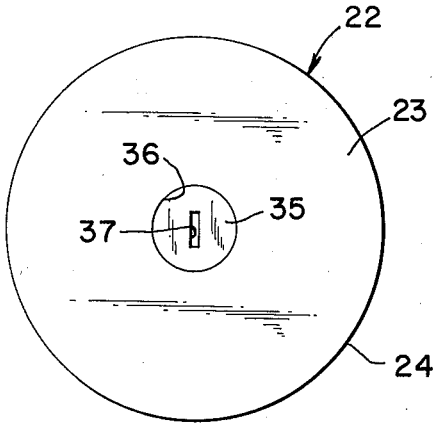
FIG. 4 is a top plan view of the container of FIG. 1, as seen from viewing plane 4—4 of FIG. 1.

The hub portion 25 has a pair of parallel bores 27 and 28 formed therethrough, which are open at one end, and closed at the other end, with springs 29 disposed at the closed ends, for biasing locking pins 30 extend radially outward toward the inner surface of the outer wall 24. Each of the locking pins or latches 30 carries a toothed rack 32 for movement therewith, and there is a toothed gear or pinion 33 whose teeth mesh with the racks 32, so that when the pinion 33 is rotated in a proper direction, as seen in FIG. 2, both racks and their locking pins are moved axially against the bias of the springs 29, and their outer ends are retracted inside their bores, and out of the interspace 26, and hence out of the way of the inner annular rib 20, where they have extended under the rib to normally block opening of the cap.

Figure 5:
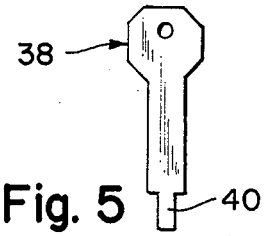
FIG. 5 is a face view of a simple type of unlocking key for opening the bottle.

To retract or unlock the pins, I provide a cylinder member 35 which is rotatable in the cylinder receiving bore 36, on insertion in the key receiving slot 37 of the key 38 shown in FIG. 5. The lower end portion 40 of the key is reduced in width to fit into a slot in the pinion 33, for turning the pinion to retract the locking pins and free the cap from the bottle. When the key is withdrawn after replacing the cap on the bottle, the springs return the locking pins to locking position. For dangerous drugs, the key may be made more complex and the safety increased Although a preferred form of the invention has been described in specific terms, it is understood that various changes may be made in size, shape, materials and arrangement without departing from the spirit and scope of the invention as claimed.

Having herein described the invention, what is claimed as new is:

1. A safety closure cap device for use with containers formed with at least one inwardly projecting abutment carried on an inner surface of the container, said closure cap device comprising major cap body means, inner body hub means, top wall means engaging said body hub means, outer skirt wall means carried by and depending from said top wall means and spaced from said inner body hub means to form a downwardly open interspace recess therebetween for reception in said interspace recess of the discharge opening end portion of said container for fitting thereover, releasable latching means carried by said inner body hub means for latching engagement with said inwardly projecting abutment on said container for latching said closure cap device to said container in closed position thereon, said latching means comprising at least one latching rod pin means carried by said inner body hub means, resilient biasing means engaging said rod pin means for biasing said pin means outwardly to latched position in latched engagement with said abutment on said container, unlatching means for retracting said pin means out of latched engagement with said abutment for unblocking removal of said closure cap device, said unlatching means including a rotatable key receiving cylinder including engaging means for engaging said pin means.

2. The construction of claim 1, and wherein said latching rod pin means comprises a plurality of latching rod pins carried by said inner body hub means for outward movement in opposite directions from each other, and wherein said engaging means comprises rack means and pinion means for retracting, against their spring bias, each of said latching rod pins out of extension into said interspace recess.

3. The construction of claim 2, and wherein said inner body hub means has a plurality of guide bores formed therein for reception of said latching rod pins, and wherein said resilient biasing means comprises springs disposed in one end of each of said guide bores for biasing said rod pins outwardly into said interspace recess, and wherein said rack means comprise a plurality of toothed racks each carried by one of said latching rod pins for movement therewith, and wherein said pinion means comprises at least one toothed pinion gear intermeshed with at least one pair of said toothed racks, for movement of said rod pins in opposite directions on rotation of said pinion gear, and said key receiving cylinder is constructed and arranged for rotation of said pinion gear.

4. The construction of claim 3, and said key receiving said rotatable cylinder has a key hole formed therethrough for reception of an unlatching key shank, and wherein said pinion gear has a keyhole slot formed therein for reception of said key shank for rotation of said cylinder and pinion gear to unlatch said cap device from said container.

* * * * *